US006024649A

United States Patent [19]

Tudek et al.

[11] Patent Number: 6,024,649

[45] Date of Patent: Feb. 15, 2000

[54] ACCURACK

[76] Inventors: Arthur L. Tudek; James Edward Tudek, both of 507 Indiana Ave., Glassport, Pa. 15045

[21] Appl. No.: 09/174,907

[22] Filed: Oct. 19, 1998

Related U.S. Application Data

[60] Provisional application No. 60/096,344, Aug. 12, 1998.

[51] Int. Cl.[7] ..... A63F 9/00; G01C 15/00

[52] U.S. Cl. ..... 473/40; 33/289

[58] Field of Search ..... 473/40, 41, 21, 473/26, 22–25; D21/316, 782; 33/289, 645, 760, 809

[56] References Cited

U.S. PATENT DOCUMENTS

| | | |
|---|---|---|
| 850,360 | 4/1907 | Flint . |
| 1,115,911 | 11/1914 | Dickinson . |
| 2,423,786 | 7/1947 | Morris . |
| 4,422,637 | 12/1983 | Bush . |
| 4,553,750 | 11/1985 | Kintz . |
| 4,736,524 | 4/1988 | King . |
| 5,601,495 | 2/1997 | Silverman . |

*Primary Examiner*—Sebastiano Passaniti

[57] ABSTRACT

This present invention relates to the game of pool. It is a device to rack pool balls with consistent accuracy. Throughout the history of pool-billiards, balls were racked by using a triangular or quadrilateral (9 ball) shaped rack in which the racker would place the balls within the rack and roll the rack of balls to a designated spot then lift and remove the rack to accomplish the task. In doing so, rackers would have to rely on their eyesight or judgement for a perfect alignment. This was indeed difficult to achieve because when the rack of balls were rolled over to the designated spot, the racker could not see the designated spot because the lead ball was covering the designated spot so the racker had to approximate the stop of the balls. It could be a little too forward or a little too backward. In the same motion of doing the racking, the racker might turn the rack a few degrees to the left or to the right thus giving an inaccurate alignment in a different plane. This present invention of an improved rack alleviates and eliminates the guess-work of racking the balls. This is accomplished by utilizing said balls rack with a T-square means attached as one unit.

4 Claims, 3 Drawing Sheets

ACCURACK

This application claims benefit of provisional application No. 60/096,344 filed Aug. 12, 1998.

BRIEF SUMMARY OF THE INVENTION

This invention of pool ball racks with a T-square permanently attached provides the game with the needed instrument to rack balls in perfect alignment consistently.

In racking the balls with said invention, the racker would also place the balls within the confines of the rack and pull the rack towards the racker and rest the straightedge of the T-square against the foot rail while aligning a hair line marking located at the top center of the straightedge and a dot marking located on the nose of the cushion in the middle of the foot rail. The racker would now place his or her fingers between the base of the triangle or quadrilateral, whichever the case may be, to tighten up the balls, then lift the entire rack off the table. This would achieve a highly accurate rack of the balls because by resting the straightedge on the rail assures that the lead ball is in proper position and by aligning the hair line of the straightedge to the dot marking on the foot cushion would assure no variance in the other plane.

In the pool-billiard industry, there are several sizes of tables produced. The different sizes measuring from nose to nose of the rubber rail are 32"×64", 38"×76", 44"×88", 46"×92" and 50"×100". The spot where the lead ball is positioned is half the distance of the smaller number of the dimension. Example: If a table is a 44"×88" table, then the foot spot would be 22" away from the nose of the cushion at the center and that is where the lead ball would be located.

Because of the different size tables, this invention provides a telescopic T-square rack to accomodate all size tables by extending or retracting it to a specific table. This invention also provides a single T-square rack without the telescopic capability designed to fit a specific table.

CROSS REFERENCE TO PRIOR ART

The following three patents cited have in their title, "ball racks for pool tables or an apparatus to indicate ball position", but none have the purpose of racking the balls accurately.

In T. Bugg and David Ivey's U.S. Pat. No. 269,825, Titled "Ball Rack For Pool Tables", it shows an attachment to racks to deposit balls on the table through a tube to save time. In John English's U.S. Pat. No. 3,680,859, his title is "Combined Billiard Balls Rack And Indicator For Placing The Balls" in which he shows a game of billiards and cards. In Gerald Hill's U.S. Pat. No. 3,466038, entitled "Apparatus And Method To Selectively Indicate Ball Positions", his object is to predetermine the location of balls on the playing surface.

SUMMARY OF THE INVENTION

The object of this present invention is to provide a triangular or quadrilateral (rhombus) rack with a T-square permanently attached as one unit to function as a highly accurate pool balls rack. The consistent accuracy of racking of the balls results from the placing of the straight edge of the T-square with its hair line marking to the dot marking located in the center of the nose of the cushion at the foot rail.

This and other objects and advantages will be apparent as the specification is considered with accompaying drawings, wherein FIG. 1 is a top view of the triangular rack (15 ball) with the telescopic T-square permanently attached as one unit.

DETAILED DESCRIPTION

Figure 1:
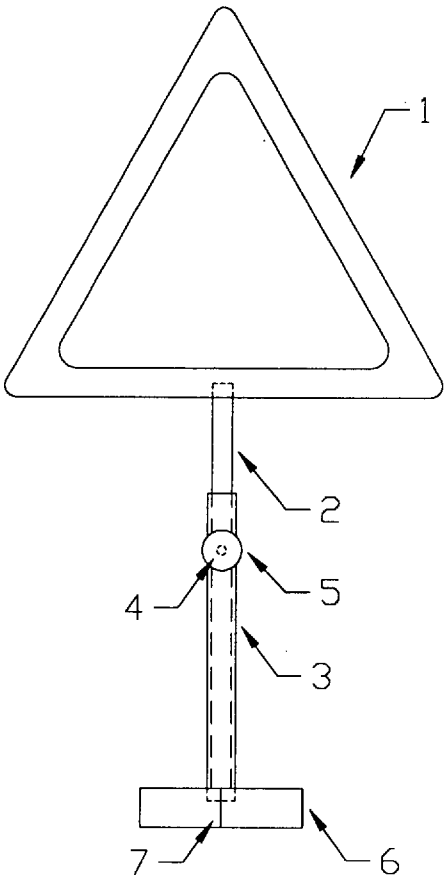

Referring more particularly to the drawing, wherein similar reference character designate like parts throughout the view, as best shown in FIG. 1 numeral 1 identifies the triangle. At the base of triangle 1, centrally located is a rod 2. Slipped over the rod 2 is a tubular pipe 3 to fit snugly for sliding or telescopic ability. At the top part of pipe 3 is threaded hole 4 to house the screw knob 5 to stabilize the telescopic means for different size setting. Connected to pipe 3 at the southern point of the invention is a straight edge bar 6. At the top and in the center of bar 6 is a hair line 7 etched into bar 6 to allow for accurate alignment with a dot 8 on the nose of the cushion at the middle of the foot rail. (Shown in FIG. 3)

Figure 2:
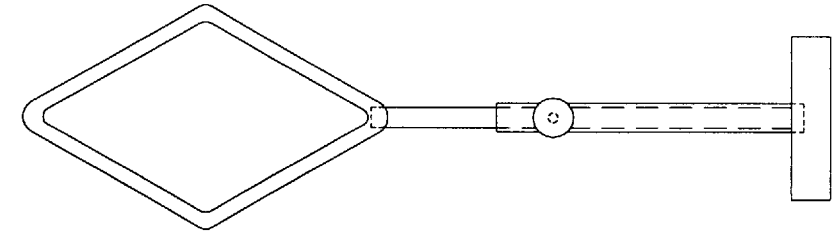
FIG. 2 is a top view of the quadrilateral rack (9 ball) also with the telescopic T-square permanently attached.

FIG. 2 is identical in nomenclature except the racking enclosure is a quadrilateral configuration.

Figure 3:
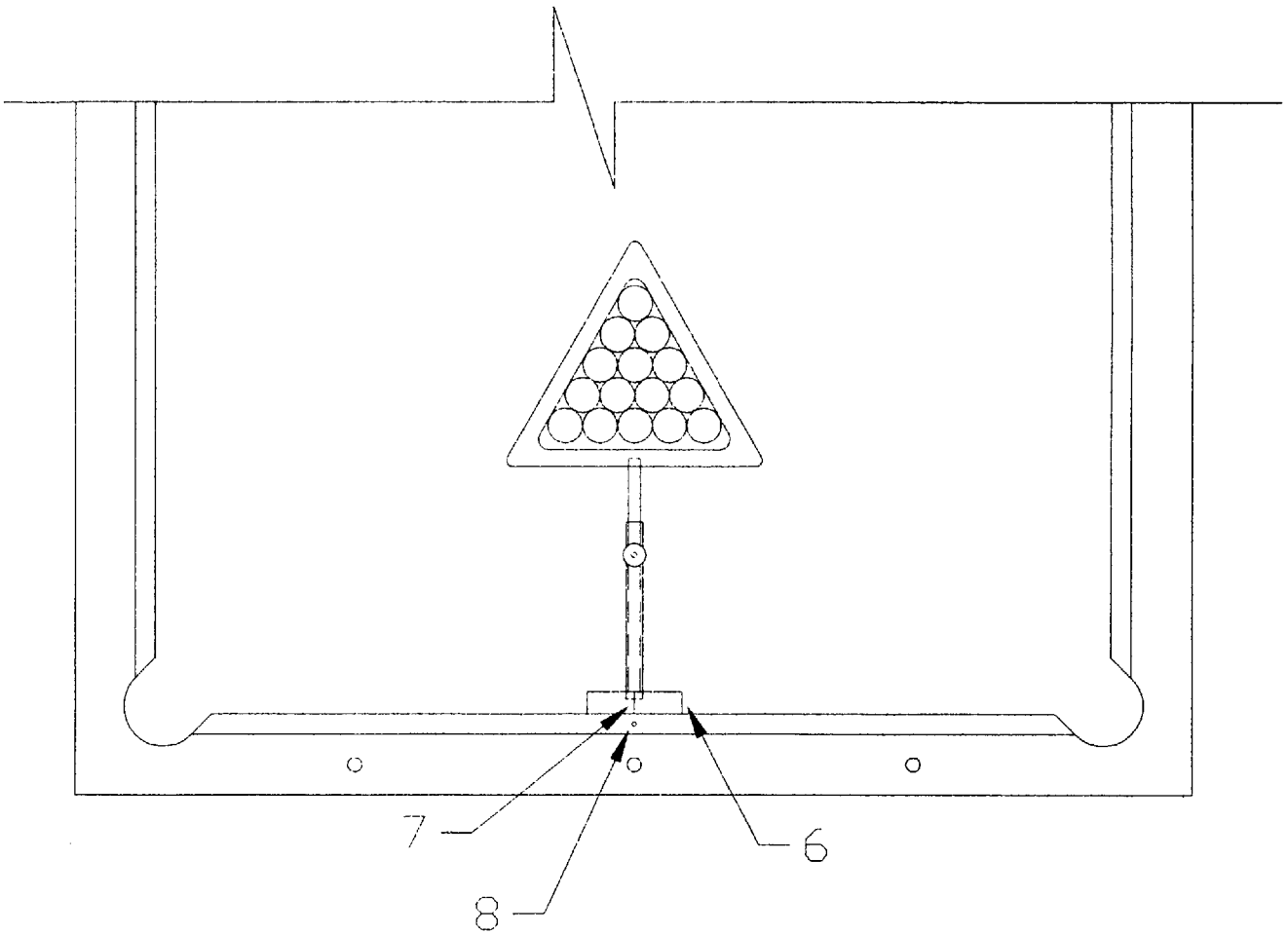
FIG. 3 is a top view of the triangular rack of balls with the telescopic T-square located at the cushion of the foot rail showing the reference to the markings of the hair line on the straight edge and the dot marking on the nose of the cushion.

FIG. 3 shows the triangular T-square rack with balls, located and situated on a pool table at the exact spot of an accurate racking of the balls showing the position of the straightedge bar 6 and the hair line 7 on bar 6 with reference to the dot 8 on the cushion of the foot rail.

Figure 4:
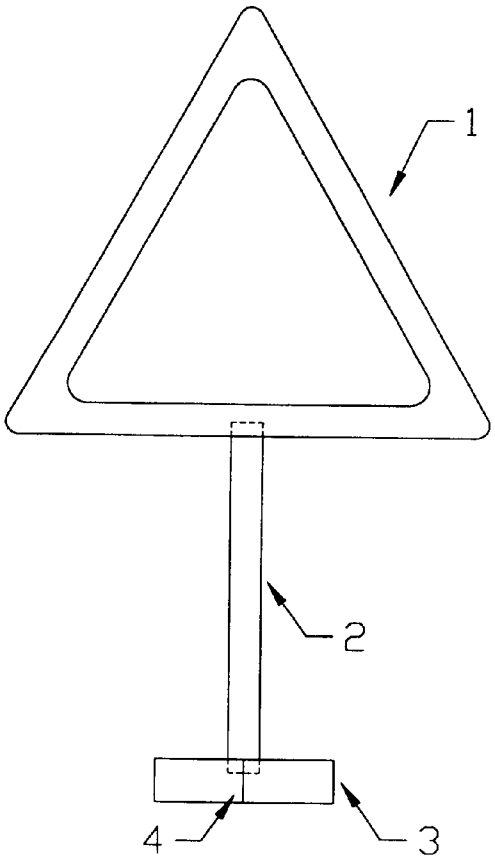
FIG. 4 is a top view of the triangular rack with a one piece T-square permanently attached.

FIG. 4 numeral 1 identifies the triangle. At the base of triangle 1, centrally located is the T-square comprising the rod 2 and the straightedge bar 3. Etched upon bar 3 is the hair line 4.

Figure 5:
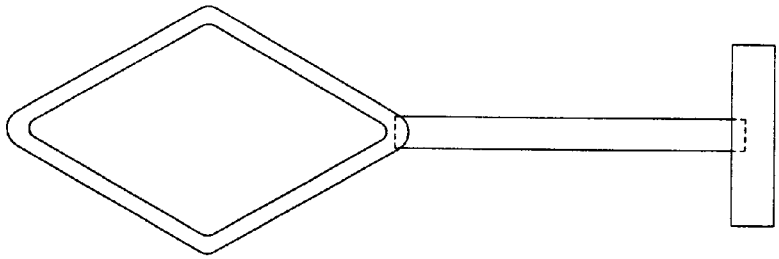
FIG. 5 is top view of the quadrilateral rack with one piece T-square permanently attached.

FIG. 5 is the same numerical nomenclature as FIG. 4, except the racking enclosure is a quadrilateral configuration.

While a preferred embodiement of a pool ball rack with a telescopic T-square and a non-telescopic T-square for the purpose of racking pool balls consistently accurate is hereby shown and described, it is to be understood that various changes and improvements may be made therein without departing from the scope and spirit of the appended claims.

I claim:

1. A ball rack device for use with a plurality of billiard or pool tables of varying size of the type having a table assembly, wherein the device may be abutted against a foot rail portion of the table assembly so that the lead ball used in a biliard or pool game may be centered accurately on the foot spot with respect to the length dimension of the table assembly, wherein the foot spot is defined as exactly half of the distance of the dimension from nose-to-nose of the rubber rail along the width dimension of the table assembly, said-ball rack device comprising:

an encasement having a triangular or quadrilateral configuration in plan view and having a base at one end;

an extension means extending from said encasement; said extension means being permanently attached to said base of said encasement and shaped in the form of a T-square assembly; said T-square including a rod connected centrally along the base of the encasement and extending away from said encasement; a pipe member slidingly connected to said rod; and a bar connected to said pipe member remotely located from said base;

whereby the ball rack device may be telescopically adjusted to accomodate differently sized table assemblies so that the lead ball may be accurately located.

2. The ball rack device of claim 1, wherein said pipe member and said rod are connected by a telescopic means for enabling the T-square assembly to be retracted and extended.

3. The ball rack device of claim 1, wherein said pipe member and said rod are connected by a permanent connection for not enabling the T-square assembly to be retracted or extended.

4. The ball rack device of claim 1, wherein the base of the T-square assembly is etched with a line marking at the center of said base for the purpose of aligning the ball rack device with the center marking of the rubber rail.

* * * * *